United States Patent [19]

Faria

[11] Patent Number: 4,619,882

[45] Date of Patent: Oct. 28, 1986

[54] PHOTOCONDUCTORS OF REDUCED PHOTOSENSITIVITY AND PROCESS FOR PRODUCING SAME

[75] Inventor: Sixdeniel Faria, Towanda, Pa.

[73] Assignee: GTE Products Corporation, Stamford, Conn.

[21] Appl. No.: 737,998

[22] Filed: May 28, 1985

[51] Int. Cl.[4] ..... G03G 5/08

[52] U.S. Cl. ..... 430/95; 430/94

[58] Field of Search ..... 430/95, 89, 90, 94; 252/501.1

[56] References Cited

U.S. PATENT DOCUMENTS

| | | | |
|---|---|---|---|
| 3,565,686 | 2/1971 | Babcock et al. | 430/94 |
| 4,338,389 | 7/1982 | Suzuki et al. | 430/94 |
| 4,495,265 | 1/1985 | Faria | 252/501.1 |

*Primary Examiner*—John L. Goodrow

*Attorney, Agent, or Firm*—Donald R. Castle; L. Rita Quatrini

[57] ABSTRACT

A copper activated photoconductor is disclosed having reduced photosensitivity and the general formula X:Cu wherein X is selected from the group consisting of CdS, CdSe, and Cd(S,Se), and an iron content of from about 0.01% to about 0.05% by weight the presence of which reduces the photosensitivity of the photoconductor by about 30%.

A process is disclosed for reducing the photosensitivity of a photoconductor. The process involves forming a relatively uniform admixture consisting essentially of copper, iron, the copper and iron being added in amounts which result in a copper level of from about 0.01% to about 0.09% and an iron content of from about 0.01% to about 0.05% by weight in the final reduced photosensitive photoconductor, from about 3% to about 10% cadmium chloride, from about 2% to about 30% by weight Y wherein Y is selected from the group consisting of S, Se, and mixtures thereof, and the balance being the photoconductor having the formula X:Cu with X as described above, and wherein Y is the same as the anionic composition of the photoconductor. The admixture is heated at a sufficient temperature for a sufficient time to form a reduced photosensitive photoconductor material which is cooled under nitrogen to ambient temperature. The portion of the material having an average particle size no greater than about 3 microns is separated from the balance of the material, washed with water to remove any water soluble impurities and dried to form the final reduced photosensitive photoconductor.

9 Claims, 2 Drawing Figures

PHOTOCONDUCTORS OF REDUCED PHOTOSENSITIVITY AND PROCESS FOR PRODUCING SAME

BACKGROUND OF THE INVENTION

This invention relates to a process for reducing the photosensitivity of photoconductors and to the photoconductor of reduced photosensitivity thus produced. More particularly it relates to a process for reducing the pohotosensitivity of photoconductors by adding iron to the photoconductor and to the photoconductor thus produced.

Chemical abstract No. CA97(4):31262u, 1982 discloses a method for increasing the production of copies of high contrast which includes addition of iron to a level of about 1.7% in a cadmium sulfide photoconductor.

CdS:Cu, CdSe:Cu, and Cd(S,Se):Cu are well known photoconductors and are used extensively in photocopiers. These photoconductors or electrophotographic materials are optimized to yield high photosensitivities throughout the visible spectrum. Highly photosensitive CdS:Cu is prepared at copper concentrations ranging between about 100 and about 300 parts per million.

There are copier applications in which this high photosensitivity is not required, such as in applications in which high intensity lamps are used. In this case the photoconductor need not be as photosensitive as with lower intensity lamps.

Advantages of reduced photosensitivity are that photoconductors can be prepared by simplified conditions resulting in less processing time. Furthermore, ultrapure materials need not be used which favors the economics because cheaper materials can be used.

Therefore, a process in which photoconductors having reduced photosensitivity are produced would be desirable and an advancement in the art.

SUMMARY OF THE INVENTION

In accordance with one aspect of this invention, there is provided a copper activated photoconductor having reduced photosensitivity and having the general formula X:Cu wherein X is selected from the group consisting of CdS, CdSe, and Cd(S,Se). The photoconductor has an iron content of from about 0.01% to about 0.05% by weight the iron being relatively uniformly distributed throughout the photoconductor the presence of the iron reducing the photosensitivity of the photoconductor by about 30%.

In accordance with another aspect of this invention, there is provided a process for reducing the photosensitivity of a photoconductor. The process involves forming a relatively uniform admixture consisting essentially of copper, iron, the copper and iron being added in amounts which result in a copper level of from about 0.01% to about 0.09% by weight and an iron content of from about 0.01% to about 0.05% by weight in the final reduced photosensitive photoconductor, from about 3% to about 10% by weight cadmium chloride, from about 2% to about 30% by weight of Y wherein Y is selected from the group consisting of S, Se, and mixtures thereof, and the balance a photoconductor having the general formula X:Cu wherein X is selected from the group consisting of CdS, CdSe, and Cd(S,Se) and wherein Y is the same as the anionic composition of the photoconductor. The admixture is heated at a sufficient temperature for a sufficient time to form a reduced photosensitive photoconductor material which is then cooled under nitrogen to ambient temperature. The portion of the material having an average particle size of no greater than about 3 microns is then separated from the balance of the material. This portion is then washed with water to remove any water soluble impurities, and heated at a sufficient temperature to remove the water and form the final reduced photosensitive photoconductor.

DETAILED DESCRIPTION OF THE INVENTION

Figure 1:
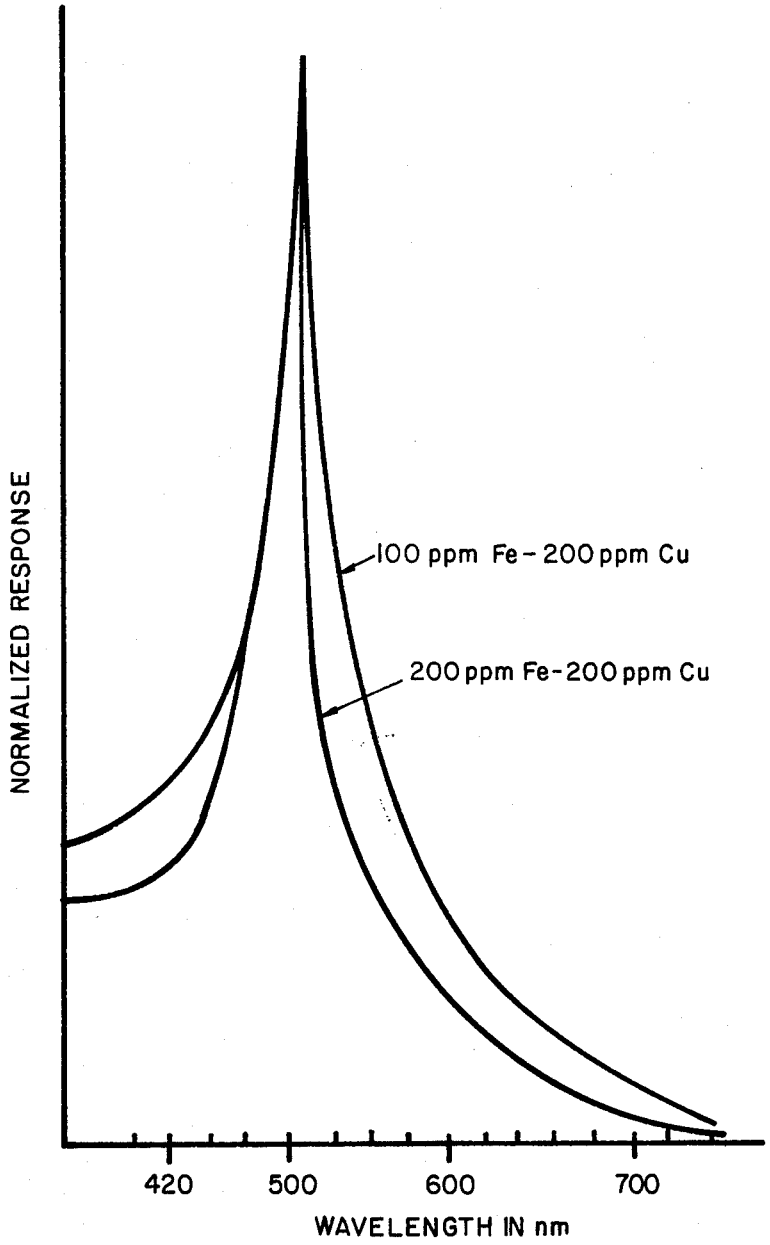
FIG. 1 is a plot of the normalized response versus various wave lengths in nanometers for iron contents of about 100 ppm and about 200 ppm in CdS:Cu in which the copper content is about 200 ppm.

For a better understanding of the present invention, together with other and further objects, advantages, and capabilities thereof, reference is made to the following disclosure and appended claims in connection with the above described drawings and description of some of the aspects of the invention.

A relatively uniform admixture is formed consisting essentially of copper, iron, the copper and iron being added in amounts which result in a copper level of from about 0.01% to about 0.09% by weight and an iron content of from about 0.01% to about 0.05% by weight in the final reduced photosensitive photoconductor, from about 3% to about 10% by weight of anhydrous cadmium chloride, from about 2% to about 30% by weight of Y wherein Y is selected from the group consisting of S, Se, and mixtures thereof, and the balance of photoconductor having the general formula X:Cu wherein X is selected from the group consisting of CdS, CdSe, and Cd(S,Se), and wherein Y is the same as the anionic composition of the photoconductor. The copper and iron are added as salts with the preferred respective salts being copper sulfate and ferric chloride. Because the desired levels of copper and iron are relatively low, the preferred method of adding the copper and iron is to form premixes of cadmium sulfide and the copper salt and of cadmium sulfide and the iron salt. For example, a typical premix of cadmium sulfide and copper sulfate contains copper at a level of about 1% by weight. A typical premix of cadmium sulfide and ferric chloride contains iron at a level of about 1% by weight. One example of a typical admixture composition is as follows in weight parts : about 6 parts of anhydrous cadmium chloride, about 6 parts of sulfur, about 7.2 parts of a premix of cadmium sulfide-copper sulfate containing about 0.01 parts of copper, about 1.3 parts of a premix of cadmium sulfide-ferric chloride containing about 0.01 parts of iron and about 112.8 parts of a CdS:Cu, Cl photoconductor having a copper content of about 200 parts of copper per milllion. When processing of the admixture is complete, that is, after the heating and washing steps, the levels of copper and iron in the final reduced photosensitive photoconductor will be in the desired ranges.

Preferred CdS:Cu and Cd(S,Se):Cu photoconductors are supplied by the Chemical and Metallurgical Division of GTE Products Corporation under the names of PC-108 and PC-105 respectively.

The components of the admixture are then blended by any conventional method which will result in the admixture being relatively uniform. A preferred method of blending the components is in a conventional V blender.

The resulting admixture is then heated at a sufficient temperature for a sufficient time in a nitrogen atmosphere to diffuse both the copper and the iron into the photoconductor lattice and form a reduced photosensitive photoconductor material. The preferred heating temperatures are from about 400° C. to about 600° C. Heating times depend on the amount of material being heated.

The resulting reduced photosensitive photoconductor is then cooled under nitrogen to ambient temperature.

The portion of the reduced photosensitive photoconductor material having an average particle size of no greater than about 3 microns is then separated from the balance of the material. This is preferably done by slurrying the material in water and passing the resulting slurry through a nylon screen of about 360 mesh to separate out the out of size material having an average particle size of greater than about 3 microns. The water is then removed from the screened photoconductor preferably by filtration.

The resulting screened portion of the material is then washed with water, preferably hot deionized water to remove the water soluble impurities. Generally the washing is carried out with one or more portions of clean water until the wash water is about neutral in pH. the wash water is removed generally by decantation or by filtration.

The resulting washed material is then heated at a sufficient temperature preferably at no greater than about 130° C. to remove essentially all of the water and form the final reduced photosensitive photoconductor.

The final reduced photosensitive photoconductor is copper activated and has the general formula X:Cu wherein X is selected from the group consisting of CdS, CdSe, and Cd(S,Se) and an iron content of from about 0.01% to about 0.05% by weight, with the presence of iron reducing the photosensitivity of the photoconductor by about 30%. The copper content is preferably from about 0.01% to about 0.09% by weight. The most preferred copper and iron weight levels are from about 0.02% to about 0.07% copper and from about 0.01% to about 0.03% iron.

The incorporation of iron into the photoconductors reduces their photosensitivity or photoconductive properties, in particular the image voltage and the photodischarge rate. Addition of iron also results in a decrease in the long wave length response.

Figure 2:
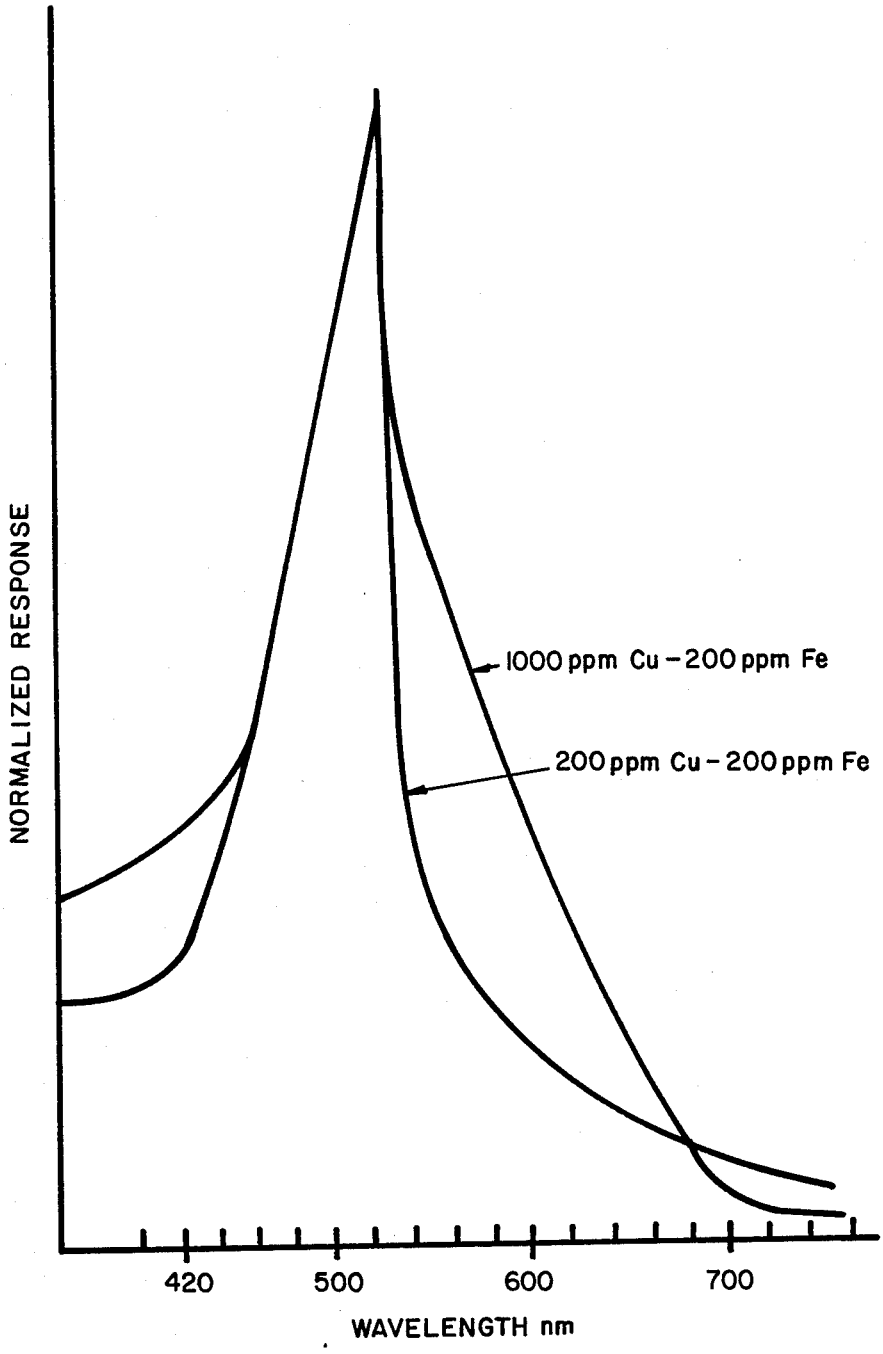
FIG. 2 is a plot of the normalized response versus various wave lengths in nanometers for copper contents of about 200 ppm and about 1000 ppm in CdS:Cu in which iron is about 200 ppm.

Chemical abstracts No. CA97(4):312624 entitled "Photoconductive Cadmium Sulfide" from Japanese Patent Appl. 80/121,543, Sept. 2, 1980 describes a photoconductor in which the iron level is about 1.7% by weight. According to this article, about 100 grams of CdS is mixed with about 0.05 g of $CuCl_2$, about 0.05 g of $FeCl_3$, about 5 g of $CdCl_2$, in aqueous solution, dried, heated at about 450° for about 1 hour, washed and dried. A photosensitive film containing the above composition produced greater than 105 electrophotographic copies of high contrast as compared to 50,000 copies with varying contrast for a $FeCl_3$-free control. FIG. 1 is a plot of the normalized response versus various wave lengths in nanometers measured with a microwave spectrometer for iron contents of about 100 ppm and about 200 ppm in CdS:Cu in which copper is about 200 ppm. It can be seen that the effect of relatively high iron lowers the response at the relatively long wavelengths. FIG. 2 is a plot of the normalized response versus various wave lengths in nanometers for copper contents of about 200 ppm and about 1000 ppm in CdS:Cu in which iron is about 200 ppm. It can be seen that the high copper CdS has a high response at the longer wave lengths than the low copper CdS. In other words, the high copper CdS has a greater response to red light which in the application is undesirable. Although normally high copper photoconductors have low image voltage, the addition of iron reduces the image voltage even lower. To more fully illustrate this invention, the following non-limiting examples are presented.

EXAMPLE 1

To Cd(S,Se):Cu in which CdS is about 97% by weight and selenium is about 3% by weight and copper is about 200 ppm is added iron in varying amounts. The resulting mixture is heated at about 500° C. for about 1 hour in a flowing nitrogen atmosphere. The resulting photoconductor is evaluated for photoconducting properties by thr following procedure. The photoconductor is dispersed in a lacquer binder solution consisting essentially of a diabasic mofidifed vinyl chloride vinyl acetate resin dissolved in methyl-isobutyl ketone. A thin layer of the resulting slurry is coated on a conductive substrate such as aluminum or aluminized polyester. The resulting coated substrate is then air dried to remove solvent and to form the photoconductive layer. A layer of transparent adhesive backed polyester is then thermally bonded to the photoconductive layer by means of a laminator. The resulting finished photoconductor coated substrate or photoreceptor is then evaluated in a copier by measuring charging voltage which is essentially the same as image voltage, and the photodischarge rate. The results are summarized below.

| ppm Fe in photoconductor | Charging Voltage | Photodischarge Rate μ/sec |
|---|---|---|
| 0 | +700 | 400 |
| 100 | +650 | 371 |
| 200 | +550 | 314 |
| 400 | +500 | 285 |

It can be seen that the charging voltage (image voltage) is reduced with increasing iron content with the particular copier.

EXAMPLE 2

The procedure in Example 1 is followed in coating a substrate with a CdS:Cu, Cl photoconductor containing varying amounts of iron. The finished photoconductor coated substrate is then evaluated in another copier. The results are summarized below.

| ppm Fe in photoconductor | Charging Voltage | Photodischarge Rate μ/sec |
|---|---|---|
| 100 | +640 | 365 |
| 200 | +380 | 223 |
| 400 | +400 | 235 |

Again it can be seen that the charging voltage (image voltage) is reduced with increasing iron content in the same copier, with the charging voltage value leveling off at about 200 ppm iron.

While there has been shown and described what are at present considered the preferred embodiments of the invention, it will be obvious to those skilled in the art that various changes and modifications may be made therein without departing from the scope of the invention as defined by the appended claims.

What is claimed is:

1. A copper activated photoconductor having reduced photosensitivity and having the general formula CdX:Cu wherein X is selected from the group consisting of sulfide, selenide and mixtures thereof, said photoconductor having an iron content of from about 0.01% to about 0.05% by weight, the presence of said iron reducing the photosensitivity of said photoconductor by about 30%.

2. A photoconductor of claim 1 wherein the copper content is from about 0.01% to about 0.09% by weight.

3. A photoconductor of claim 2 wherein the copper content is from about 0.02% to about 0.07% by weight and the iron content is from about 0.01% to about 0.03% by weight.

4. A process for reducing the photosensitivity of a photoconductor, said process comprising:

(a) forming a relatively uniform admixture consisting essentially of copper, iron, the copper and iron being added in amounts which result in a copper level of from about 0.01% to about 0.09% by weight and an iron content of from about 0.01% to about 0.05% by weight in the final reduced photosensitive photoconductor, from about 3.0% to about 10% by weight cadmium chloride, from about 2% to about 30% Y wherein Y is selected from the group consisting of S, Se, and mixtures thereof, and the balance a photoconductor having the general formula X:Cu wherein X is selected from the group consisting of CdS, CdSe, and Cd(S,Se), and wherein Y is the same as the anionic composition of said photoconductor;

(b) heating said admixture at a sufficient temperature for a sufficient time to form a reduced photosensitive photoconductor material;

(c) cooling said material under nitrogen to ambient temperature;

(d) separating the portion of the reduced photosensitive photoconductor material having an average particle size of no greater than about 3 microns from the balance of said material;

(e) washing said portion of the reduced photosensitive photoconductive material in water to remove water soluble impurities from said portion; and (f) heating said portion at a sufficient temperature to remove essentially all of the water from said portion and to form the final reduced photosensitive photoconductor.

5. A process according to claim 4 wherein the iron and copper are in said admixture as ferric chloride and copper sulfate respectively.

6. A process according to claim 4 wherein the admixture is heated at from about 400° C. to about 600° C.

7. A process according to claim 4 wherein the final reduced photosensitive photoconductor is copper activated and has the general formula X:Cu wherein X is selected from the group consisting of CdS, CdSe, and Cd(S,Se), and an iron content of from about 0.01% to about 0.05% by weight, with the presence of the iron rducing the photosensitivity of said photoconductor by about 30%.

8. A process according to claim 7 wherein the copper content is from about 0.01% to about 0.09% by weight.

9. A process according to claim 8 wherein the copper content is from about 0.02% to about 0.07% by weight and the iron content is from about 0.01% to about 0.03% by weight.

* * * * *